US011221143B2

(12) United States Patent
Stevens et al.

(10) Patent No.: US 11,221,143 B2
(45) Date of Patent: Jan. 11, 2022

(54) COMBUSTOR AND METHOD OF OPERATION FOR IMPROVED EMISSIONS AND DURABILITY

(71) Applicant: General Electric Company, Schenectady, NY (US)

(72) Inventors: Eric John Stevens, Mason, OH (US); Allen Michael Danis, Mason, OH (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 122 days.

(21) Appl. No.: 15/883,573

(22) Filed: Jan. 30, 2018

(65) Prior Publication Data

US 2019/0234615 A1 Aug. 1, 2019

(51) Int. Cl.

| | |
|---|---|
| ***F23R 3/26*** | (2006.01) |
| ***F23R 3/00*** | (2006.01) |
| ***F23R 3/16*** | (2006.01) |
| ***F23R 3/10*** | (2006.01) |

(52) U.S. Cl.

CPC ..... *F23R 3/26* (2013.01); *F23R 3/002* (2013.01); *F23R 3/10* (2013.01); *F23R 3/16* (2013.01); *F05D 2240/35* (2013.01); *F05D 2270/08* (2013.01)

(58) Field of Classification Search

CPC .... F23R 3/286; F23R 3/26; F23R 3/14; F23R 3/10; F23R 2900/03041; F05D 2270/08

See application file for complete search history.

(56) References Cited

U.S. PATENT DOCUMENTS

| | | | | |
|---|---|---|---|---|
| 3,631,674 A * | 1/1972 | Taylor | F23R 3/42 | 60/804 |
| 5,288,021 A * | 2/1994 | Sood | F23C 7/004 | 239/132.5 |
| 5,623,827 A * | 4/1997 | Monty | F23R 3/10 | 60/747 |

(Continued)

FOREIGN PATENT DOCUMENTS

| | | |
|---|---|---|
| CA | 2644383 A1 | 7/2009 |
| CN | 204176683 U | 2/2015 |
| CN | 106687745 A | 5/2017 |

OTHER PUBLICATIONS

Office Action and Search Report issued in corresponding Chinese Application No. 201910090559.0, dated Mar. 23, 2020. (With English language translation).

*Primary Examiner* — Katheryn A Malatek

(74) *Attorney, Agent, or Firm* — Venable LLP; Edward A. Kmett; Michele V. Frank

(57) ABSTRACT

A combustor assembly comprising a deflector wall in which a plurality of openings is defined through the deflector wall and around the fuel nozzle opening. The plurality of openings defines a first set of openings at a first radius, a second set of openings at or greater than a second radius greater than the first radius, and a third set of openings at one or more of a third radius between the first radius and the second radius. The first set of openings defines one or more of a first angle relative to the radial direction between approximately 60 degrees and approximately 100 degrees. The second set of openings defines one or more of a second angle between approximately zero and approximately 30 degrees. The third set of openings defines one or more of a third angle between the first angle and the second angle.

23 Claims, 7 Drawing Sheets

(56) References Cited

U.S. PATENT DOCUMENTS

| | | | | |
|---|---|---|---|---|
| 5,918,467 | A | 7/1999 | Kwan | |
| 5,941,076 | A * | 8/1999 | Sandelis | F23R 3/26 60/752 |
| 5,956,955 | A | 9/1999 | Schmid | |
| 6,546,733 | B2 * | 4/2003 | North | F23R 3/002 60/772 |
| 7,260,936 | B2 | 8/2007 | Patel et al. | |
| 7,451,600 | B2 | 11/2008 | Patel et al. | |
| 7,509,813 | B2 | 3/2009 | Stastny | |
| 7,614,235 | B2 | 11/2009 | Burd et al. | |
| 7,856,830 | B2 | 12/2010 | Alkabie | |
| 7,954,325 | B2 | 6/2011 | Burd et al. | |
| 8,763,399 | B2 | 7/2014 | Dodo et al. | |
| 9,322,560 | B2 | 4/2016 | Erbas-Sen et al. | |
| 9,506,652 | B2 | 11/2016 | Carrere et al. | |
| 9,746,184 | B2 | 8/2017 | Papple et al. | |
| 2004/0065090 | A1 * | 4/2004 | Al-Roub | F23R 3/14 60/776 |
| 2006/0272335 | A1 * | 12/2006 | Schumacher | F23R 3/50 60/804 |
| 2009/0013530 | A1 * | 1/2009 | Rudrapatna | F23R 3/002 29/888 |
| 2013/0078582 | A1 | 3/2013 | Pidcock | |
| 2013/0192233 | A1 | 8/2013 | Eastwood et al. | |
| 2014/0090402 | A1 | 4/2014 | Erbas-Sen et al. | |
| 2016/0025342 | A1 | 1/2016 | Erbas-Sen et al. | |
| 2016/0238250 | A1 | 8/2016 | Moura et al. | |
| 2019/0086088 | A1 | 3/2019 | Stevens et al. | |

* cited by examiner

COMBUSTOR AND METHOD OF OPERATION FOR IMPROVED EMISSIONS AND DURABILITY

FIELD

The present subject matter is related to structures and methods for operating combustors for improved emissions output and improved structural durability.

BACKGROUND

Combustors and the gas turbine engines into which they are installed are required to meet or exceed increasingly stringent emissions requirements. Combustion emissions are in part a function of a temperature of combustion products and residence time within the combustor before egressing downstream to a turbine section. Combustion emissions may further be a function of an amount of cooling air mixed with the combustion products. For example, combustor walls for gas turbine engines are exposed to high gas temperatures from combustion products, resulting in deterioration that further requires costly repair or replacement.

However, cooling air used within a gas turbine engine may provide structural durability for combustor walls while adversely affecting emissions, such as via affecting residence time or pattern factor or temperature profile of the combustion gases. As such, there is a need for a combustor that improves structural durability of combustor walls while further improving emissions output.

BRIEF DESCRIPTION

Aspects and advantages of the invention will be set forth in part in the following description, or may be obvious from the description, or may be learned through practice of the invention.

The present disclosure is directed to a combustor assembly for a gas turbine engine and a method for operation. The combustor assembly includes a deflector wall defined around a nozzle centerline extended therethrough. A radial direction is defined from the nozzle centerline. The deflector wall is extended at least partially along the radial direction and defines an upstream wall of a combustion chamber. The deflector wall defines a fuel nozzle opening through the deflector wall and around the nozzle centerline. A plurality of openings is defined through the deflector wall and around the fuel nozzle opening. The plurality of openings each define an angle at which a flow of oxidizer egresses therethrough into the combustion chamber. The plurality of openings defines a first set of openings at a first radius relative to the nozzle centerline in which the first set of openings defines one or more of a first angle relative to the radial direction between approximately 60 degrees and approximately 100 degrees. The plurality of openings further defines a second set of openings at or greater than a second radius greater than the first radius relative to the fuel nozzle opening. The second set of openings defines one or more of a second angle relative to the radial direction between approximately zero degrees and approximately 30 degrees. The plurality of openings further defines a third set of openings at one or more of a third radius between the first radius and the second radius. The third set of openings defines one or more of a third angle relative to the radial direction between the first angle and the second angle.

In one embodiment, the third angle of the third set of openings is between approximately 20 degrees and approximately 75 degrees.

In another embodiment, the first set of openings and the third set of openings are together disposed at least partially co-directional along a circumferential direction relative to the nozzle centerline.

In still another embodiment, the second set of openings is disposed at least approximately along the radial direction relative to the nozzle centerline.

In various embodiments, the combustor assembly further includes a swirler assembly disposed generally around the nozzle centerline and generally concentric to the fuel nozzle opening. The swirler assembly provides a flow of fluid into the combustion chamber at least partially along a circumferential direction relative to the nozzle centerline. In one embodiment, the flow of fluid at least partially along the circumferential direction relative to the nozzle centerline is co-directional to the flow of oxidizer egressed through the plurality of openings through the deflector wall. In another embodiment, the flow of fluid at least partially along the circumferential direction relative to the nozzle centerline is counter-directional to the flow of oxidizer egressed through the plurality of openings through the deflector wall.

In one embodiment, the flow of oxidizer egressed through the plurality of openings is between approximately 3% and approximately 10% of a total flow of oxidizer into the combustion chamber.

In another embodiment, a pressure drop of the flow of oxidizer is defined from an upstream side of the dome assembly to a downstream side of the deflector wall at the combustion chamber, wherein the pressure drop is between approximately 3% and approximately 5%.

In still another embodiment, the plurality of openings egresses the flow of oxidizer along a clockwise direction or a counter-clockwise direction relative to the nozzle centerline.

A method for operating a gas turbine engine to decrease emissions includes igniting a fuel-oxidizer mixture at a combustion chamber to produce combustion gases, wherein the combustion chamber is formed at least in part by an upstream radial wall through which a fuel nozzle is disposed; flowing an oxidizer into the combustion chamber through a first set of openings defined in an adjacent circumferential arrangement through the upstream radial wall at approximately a first radius relative to a nozzle centerline, wherein the first set of openings egresses the oxidizer into the combustion chamber at a first angle between approximately 60 degrees and approximately 100 degrees relative to a radial direction defined from the nozzle centerline; flowing the oxidizer into the combustion chamber through a second set of openings defined through the radial wall at or greater than a second radius greater than the first radius, wherein the second set of openings egresses the oxidizer into the combustion chamber at a second angle between approximately 0 degrees and approximately 30 degrees relative to the radial direction defined from the nozzle centerline; and flowing the oxidizer into the combustion chamber through a third set of openings at one or more of a third radius between the first radius and the second radius relative to the fuel nozzle opening, wherein the third set of openings egresses the oxidizer into the combustion chamber at one or more of a third angle relative to the radial direction between the first angle and the second angle.

In one embodiment of the method, flowing the oxidizer into the combustion chamber includes flowing the oxidizer through the first set of openings and the third set of openings at least partially co-directional along a circumferential direction relative to the nozzle centerline.

In another embodiment of the method, flowing the oxidizer into the combustion chamber includes flowing the oxidizer through the second set of openings generally radially outward relative to the nozzle centerline.

In various embodiments, the method further includes flowing a fluid into the combustion chamber through a swirler assembly and a fuel nozzle opening. In one embodiment, flowing the fluid through the swirler assembly and the fuel nozzle opening is at least partially co-directional to flowing the oxidizer through the first set of openings and the third set of openings. In another embodiment, flowing the fluid through the swirler assembly and the fuel nozzle opening is at least partially counter-directional to flowing the oxidizer through the first set of openings and the third set of openings. In still another embodiment, the method further includes decreasing an angular velocity of the combustion gases proximate to the radial wall via the flow of oxidizer into the combustion chamber through the first set of openings, the second set of openings, and the third set of openings.

A method for operating a combustor of a gas turbine engine to increase combustor durability includes igniting a fuel-oxidizer mixture at a combustion chamber to produce combustion gases, in which the combustion chamber is formed at least in part by an upstream radial wall through which a fuel nozzle is disposed; flowing an oxidizer into the combustion chamber through a first set of openings defined in an adjacent circumferential arrangement through the upstream radial wall at approximately a first radius relative to a nozzle centerline, wherein the first set of openings egresses the oxidizer into the combustion chamber at a first angle between approximately 60 degrees and approximately 100 degrees relative to a radial direction defined from the nozzle centerline; flowing the oxidizer into the combustion chamber through a second set of openings defined through the radial wall at or greater than a second radius greater than the first radius, wherein the second set of openings egresses the oxidizer into the combustion chamber at a second angle between approximately 0 degrees and approximately 30 degrees relative to the radial direction defined from the nozzle centerline; and flowing the oxidizer into the combustion chamber through a third set of openings at one or more of a third radius between the first radius and the second radius relative to the fuel nozzle opening, wherein the third set of openings egresses the oxidizer into the combustion chamber at one or more of a third angle relative to the radial direction between the first angle and the second angle.

In one embodiment, the method further includes decreasing an angular velocity of the combustion gases proximate to the radial wall via the flow of oxidizer into the combustion chamber through the first set of openings, the second set of openings, and the third set of openings.

In another embodiment, flowing the oxidizer into the combustion chamber includes flowing the oxidizer through the first set of openings and the third set of openings at least partially co-directional along a circumferential direction relative to the nozzle centerline.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

Figure 1:
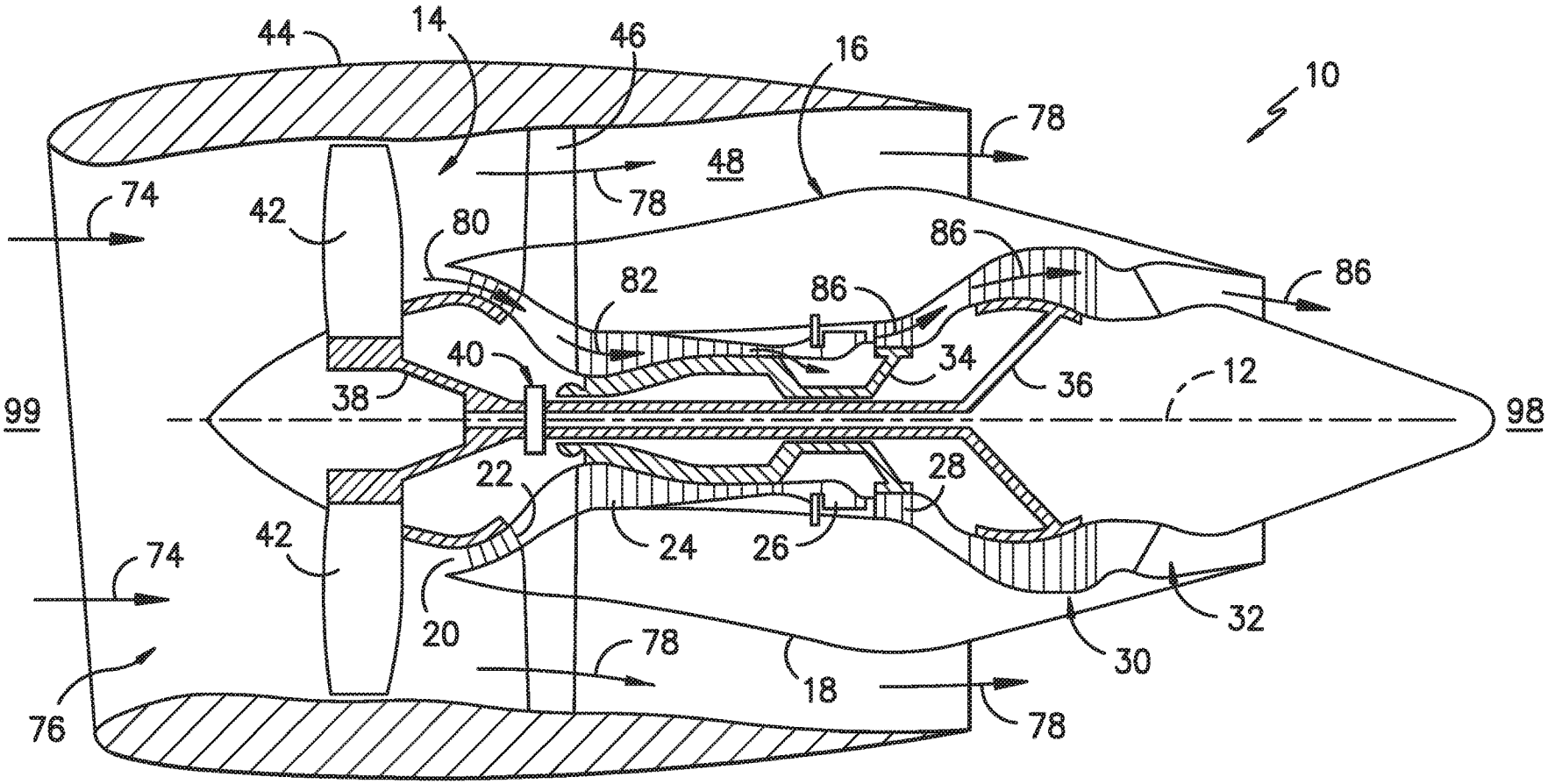
FIG. 1 is a schematic cross sectional view of an exemplary gas turbine engine incorporating an exemplary embodiment of a fuel injector and fuel nozzle assembly.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first", "second", and "third" may be used interchangeably to distinguish one component from another and are not intended to signify location or importance of the individual components.

The terms "upstream" and "downstream" refer to the relative direction with respect to fluid flow in a fluid pathway. For example, "upstream" refers to the direction from which the fluid flows, and "downstream" refers to the direction to which the fluid flows.

Unless otherwise specified, all angles defined herein are along a clockwise direction from aft looking forward (e.g., from a downstream end 98 looking toward an upstream end 99). As such, descriptions or limitations defining one or more angles or ranges thereof may be translated into complimentary angles viewed from forward looking aft, or along a counter-clockwise direction. Still further, depictions of an arrangement or flow along a first circumferential direction (e.g., clockwise) are provided for illustrative purposes only and may be oriented, arranged, or otherwise flowed along a second circumferential direction (e.g., counter-clockwise) opposite of the first circumferential direction when viewed from the same perspective (e.g., aft looking forward).

Embodiments of a combustor assembly and methods of operation that improve structural durability of combustor walls while further improving emissions output are generally provided. The combustor assembly generally includes a plurality of segments of an upstream wall or deflector wall in adjacent circumferential arrangement, in which the deflector wall is adjacent to a combustion chamber. A support wall may be defined upstream of the deflector wall and adjacent to a pressure plenum or diffuser cavity. The support wall defines an opening therethrough to a cavity between the support wall and the deflector wall. A flow of oxidizer through the support wall opening into the cavity provides impingement cooling flow of oxidizer to an upstream side of the deflector. The deflector wall defines a plurality of openings therethrough to provide the flow of oxidizer to the combustion chamber. The plurality of openings includes a first set of openings arranged to provide the flow of oxidizer at least approximately tangential relative to a fuel nozzle opening or deflector eyelet defined through the deflector wall through which a fuel nozzle is at least partially disposed. The plurality of openings further includes another set of openings, such as defining a third set of openings, arranged radially outward of the first set of openings (relative to a nozzle centerline through the fuel nozzle opening). The third set of openings provides the flow of oxidizer through the deflector wall into the combustion chamber at one or more angles between approximately tangential relative to the fuel nozzle opening and approximately radial relative to the nozzle centerline. The plurality of openings further includes yet another set of openings, such as a second set of openings, arranged radially outward of the third set of openings, such as up to or including an edge or perimeter of each segment of deflector wall. The second set of openings provides the flow of oxidizer through the deflector wall into the combustion chamber at an angle approximately radial relative to the nozzle centerline.

As such, the deflector wall defines the plurality of openings as a generally smooth transition from at least approximately tangent relative to the fuel nozzle opening to approximately radial relative to the nozzle centerline. The transition of the plurality of openings may generally minimize an interaction of the flow of oxidizer through the deflector wall into the combustion chamber with a primary combustion zone flame structure within the combustion chamber (e.g., adjacent to or otherwise proximate to the deflector wall). Minimizing the interaction or disruption of the primary combustion zone flame structure may further improve emissions output, such as by decreasing formation of oxides of nitrogen (NOx) in the combustion chamber.

Furthermore, the plurality of openings such as defined herein may further reduce an angular momentum supplied by the flow of oxidizer through the deflector wall. The nearly tangential orientation of the first set of openings 155 near the deflector eyelet or fuel nozzle opening 115 may further improve cooling, and thereby improving structural durability of the combustor assembly, while mitigating or eliminating interaction or disruption of a primary zone flame structure in the combustion chamber, thereby reducing emissions such as NOx.

The transition of the plurality of openings from providing an approximately tangential flow relative to the fuel nozzle opening to an approximately radial flow proximate to outer radii or edges of the deflector wall may generally provide deflector wall cooling while mitigating adverse effects associated with a substantially tangential arrangement or substantially radial arrangement of the plurality of openings. For example, as previously described, the transition of plurality of openings may generally decrease an angular momentum of the flow of oxidizer into the combustion chamber versus a substantially tangential arrangement of plurality of openings, thereby decreasing formation of NOx due to adverse interaction or disruption to the primary zone flame structure.

Referring now to the drawings, FIG. 1 is a schematic partially cross-sectioned side view of an exemplary gas turbine engine 10 herein referred to as "engine 10" as may incorporate various embodiments of the present invention. Although further described herein as a turbofan engine, the engine 10 may define a turboshaft, turboprop, or turbojet gas turbine engine, including marine and industrial engines and auxiliary power units. As shown in FIG. 1, the engine 10 has a longitudinal or axial centerline axis 12 that extends therethrough for reference purposes. In general, the engine 10 may include a fan assembly 14 and a core engine 16 disposed downstream from the fan assembly 14.

The core engine 16 may generally include a substantially tubular outer casing 18 that defines an annular inlet 20. The outer casing 18 encases or at least partially forms, in serial flow relationship, a compressor section having a booster or low pressure (LP) compressor 22, a high pressure (HP) compressor 24, a combustion section 26, a turbine section including a high pressure (HP) turbine 28, a low pressure (LP) turbine 30 and a jet exhaust nozzle section 32. A high pressure (HP) rotor shaft 34 drivingly connects the HP turbine 28 to the HP compressor 24. A low pressure (LP) rotor shaft 36 drivingly connects the LP turbine 30 to the LP compressor 22. The LP rotor shaft 36 may also be connected to a fan shaft 38 of the fan assembly 14. In particular embodiments, as shown in FIG. 1, the LP rotor shaft 36 may be connected to the fan shaft 38 via a reduction gear 40 such as in an indirect-drive or geared-drive configuration.

As shown in FIG. 1, the fan assembly 14 includes a plurality of fan blades 42 that are coupled to and that extend radially outwardly from the fan shaft 38. An annular fan casing or nacelle 44 circumferentially surrounds the fan assembly 14 and/or at least a portion of the core engine 16. It should be appreciated by those of ordinary skill in the art that the nacelle 44 may be configured to be supported relative to the core engine 16 by a plurality of circumferentially-spaced outlet guide vanes or struts 46. Moreover, at least a portion of the nacelle 44 may extend over an outer portion of the core engine 16 so as to define a bypass airflow passage 48 therebetween.

Figure 2:
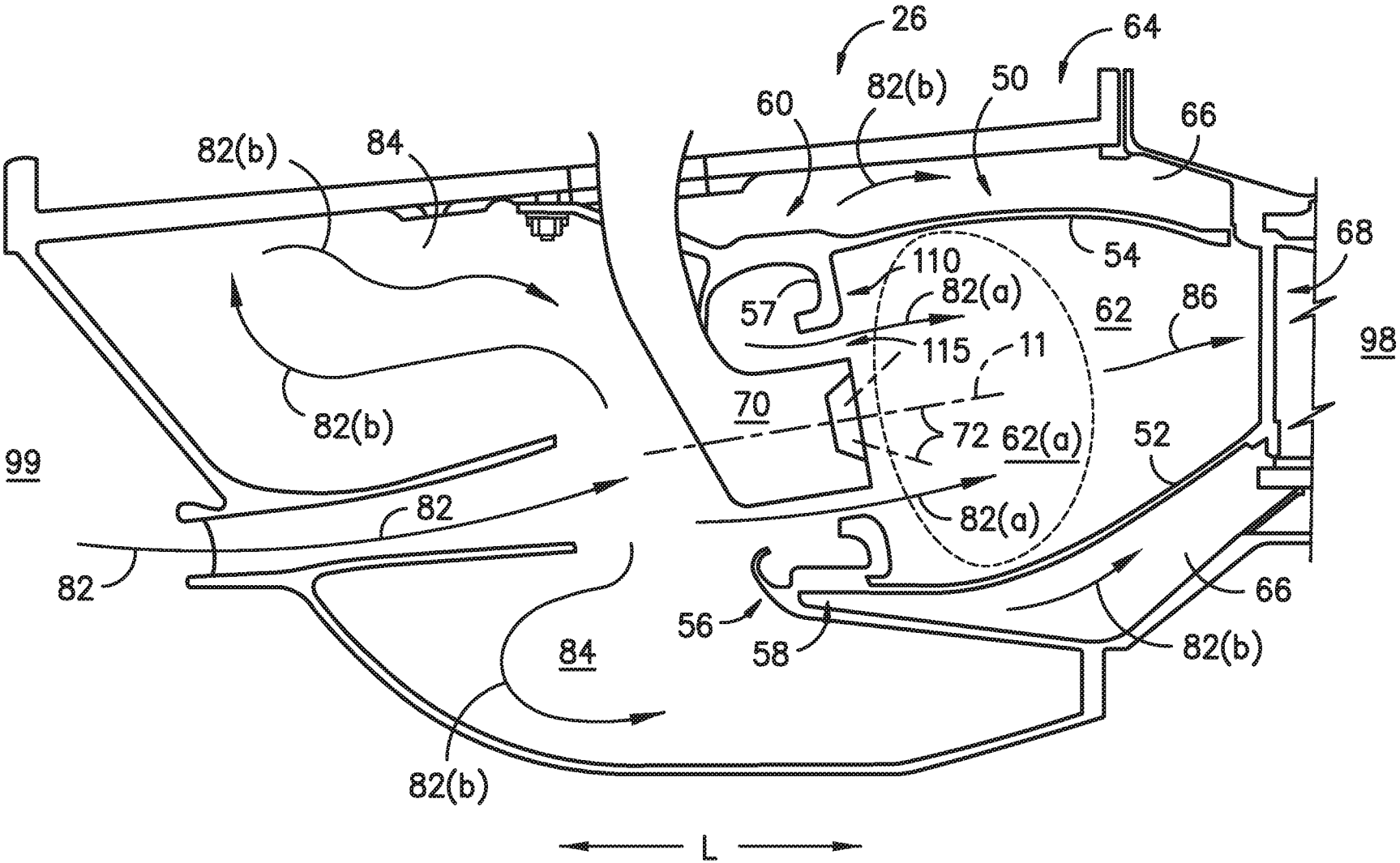
FIG. 2 is a cross sectional view of an exemplary embodiment of a combustor assembly of the exemplary engine shown in FIG. 1.

FIG. 2 is a cross sectional side view of an exemplary combustion section 26 of the core engine 16 as shown in FIG. 1. As shown in FIG. 2, the combustion section 26 may generally include an annular type combustor assembly 50 having an annular inner liner 52, an annular outer liner 54, a bulkhead wall 56, and a deflector wall 110 together defining a combustion chamber 62. The combustion chamber 62 may more specifically define a region defining a primary combustion zone 62(*a*) at which initial chemical reaction of the fuel-oxidizer mixture and/or recirculation of the combustion products may occur before flowing further downstream. The bulkhead wall 56 and the dome assembly 57 each extend radially between upstream ends 58, 60 of the radially spaced inner liner 52 and the outer liner 54, respectively. The dome assembly 57 is disposed downstream of the bulkhead wall 56, adjacent to the generally annular combustion chamber 62 defined between the dome assembly 57, the inner liner 52, and the outer liner 54. More specifically, the deflector wall 110 is defined generally adjacent to the combustion chamber 62, such as defining a generally radial upstream wall. In particular embodiments, the inner liner 52 and/or the outer liner 54 may be at least partially or entirely formed from metal alloys or ceramic matrix composite (CMC) materials.

As shown in FIG. 2, the inner liner 52 and the outer liner 54 may be encased within a diffuser or outer casing 64. An outer flow passage 66 may be defined around the inner liner 52 and/or the outer liner 54. The inner liner 52 and the outer liner 54 may extend from the bulkhead wall 56 towards a turbine nozzle or inlet 68 to the HP turbine 28 (FIG. 1), thus at least partially defining a hot gas path between the combustor assembly 50 and the HP turbine 28.

During operation of the engine 10, as shown in FIGS. 1 and 2 collectively, a volume of air as indicated schematically by arrows 74 enters the engine 10 through an associated inlet 76 of the nacelle 44 and/or fan assembly 14. As the air 74 passes across the fan blades 42 a portion of the air as indicated schematically by arrows 78 is directed or routed into the bypass airflow passage 48 while another portion of the air as indicated schematically by arrow 80 is directed or routed into the LP compressor 22. Air 80 is progressively compressed as it flows through the LP and HP compressors 22, 24 towards the combustion section 26. As shown in FIG. 2, the now compressed air as indicated schematically by arrows 82 flows into a diffuser cavity or head end portion 84 of the combustion section 26.

The compressed air 82 pressurizes the diffuser cavity 84. A first portion of the of the compressed air 82, as indicated schematically by arrows 82(*a*) flows from the diffuser cavity 84 into the combustion chamber 62 where it is mixed with the fuel 72 and burned, thus generating combustion gases, as indicated schematically by arrows 86, within the combustor assembly 50. Typically, the LP and HP compressors 22, 24 provide more compressed air to the diffuser cavity 84 than is needed for combustion. Therefore, a second portion of the compressed air 82 as indicated schematically by arrows 82(*b*) may be used for various purposes other than combustion. For example, as shown in FIG. 2, compressed air 82(*b*) may be routed into the outer flow passage 66 to provide cooling to the inner and outer liners 52, 54. In addition or in the alternative, at least a portion of compressed air 82(*b*) may be routed out of the diffuser cavity 84. For example, a portion of compressed air 82(*b*) may be directed through various flow passages to provide cooling air to at least one of the HP turbine 28 or the LP turbine 30.

Referring back to FIGS. 1 and 2 collectively, the combustion gases 86 generated in the combustion chamber 62 flow from the combustor assembly 50 into the HP turbine 28, thus causing the HP rotor shaft 34 to rotate, thereby supporting operation of the HP compressor 24. As shown in FIG. 1, the combustion gases 86 are then routed through the LP turbine 30, thus causing the LP rotor shaft 36 to rotate, thereby supporting operation of the LP compressor 22 and/or rotation of the fan shaft 38. The combustion gases 86 are then exhausted through the jet exhaust nozzle section 32 of the core engine 16 to provide propulsive thrust.

Figure 3:
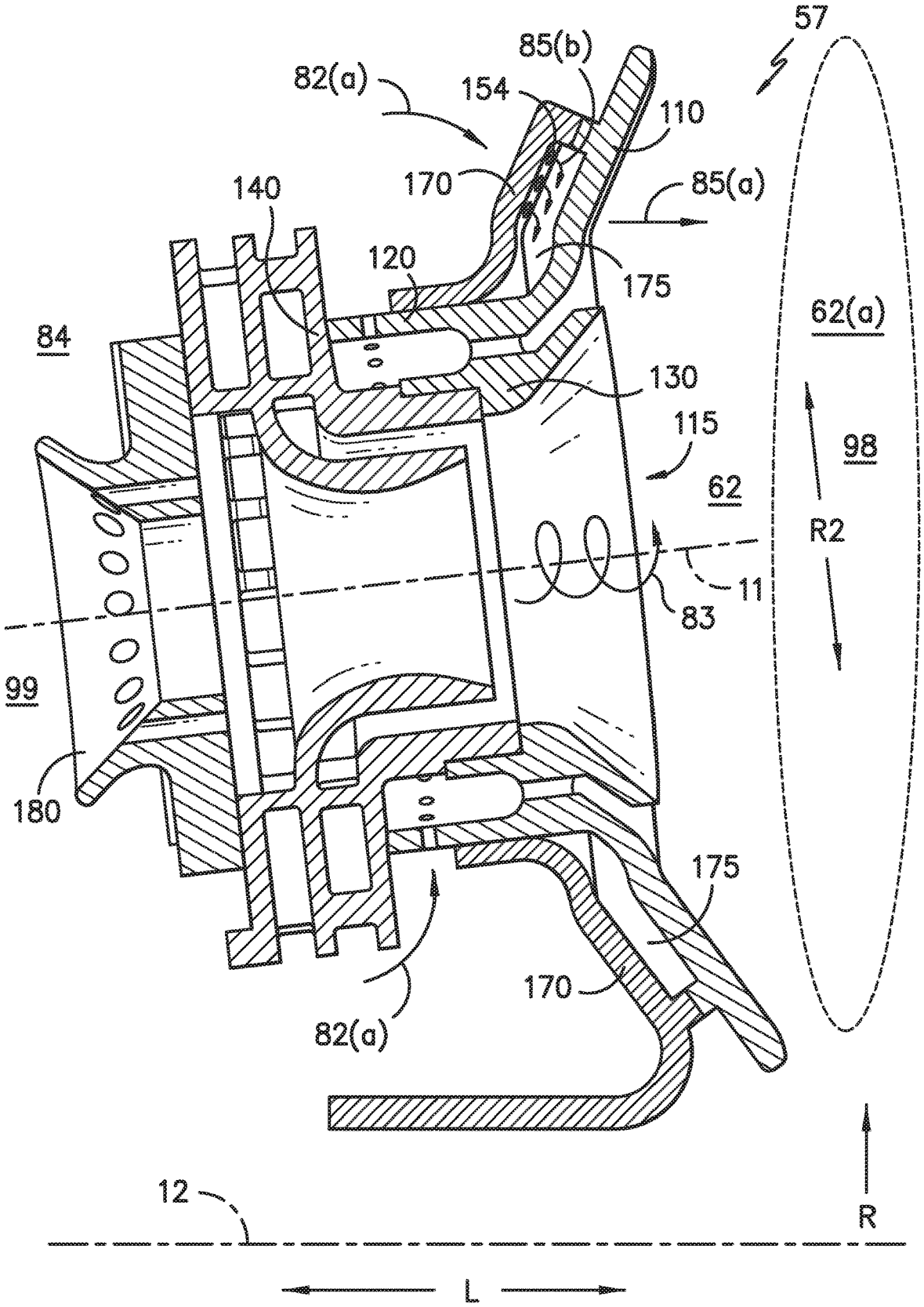
FIG. 3 is a cross sectional view of an exemplary embodiment of a portion of the combustor assembly generally provided in FIG. 2.
Figure 4:
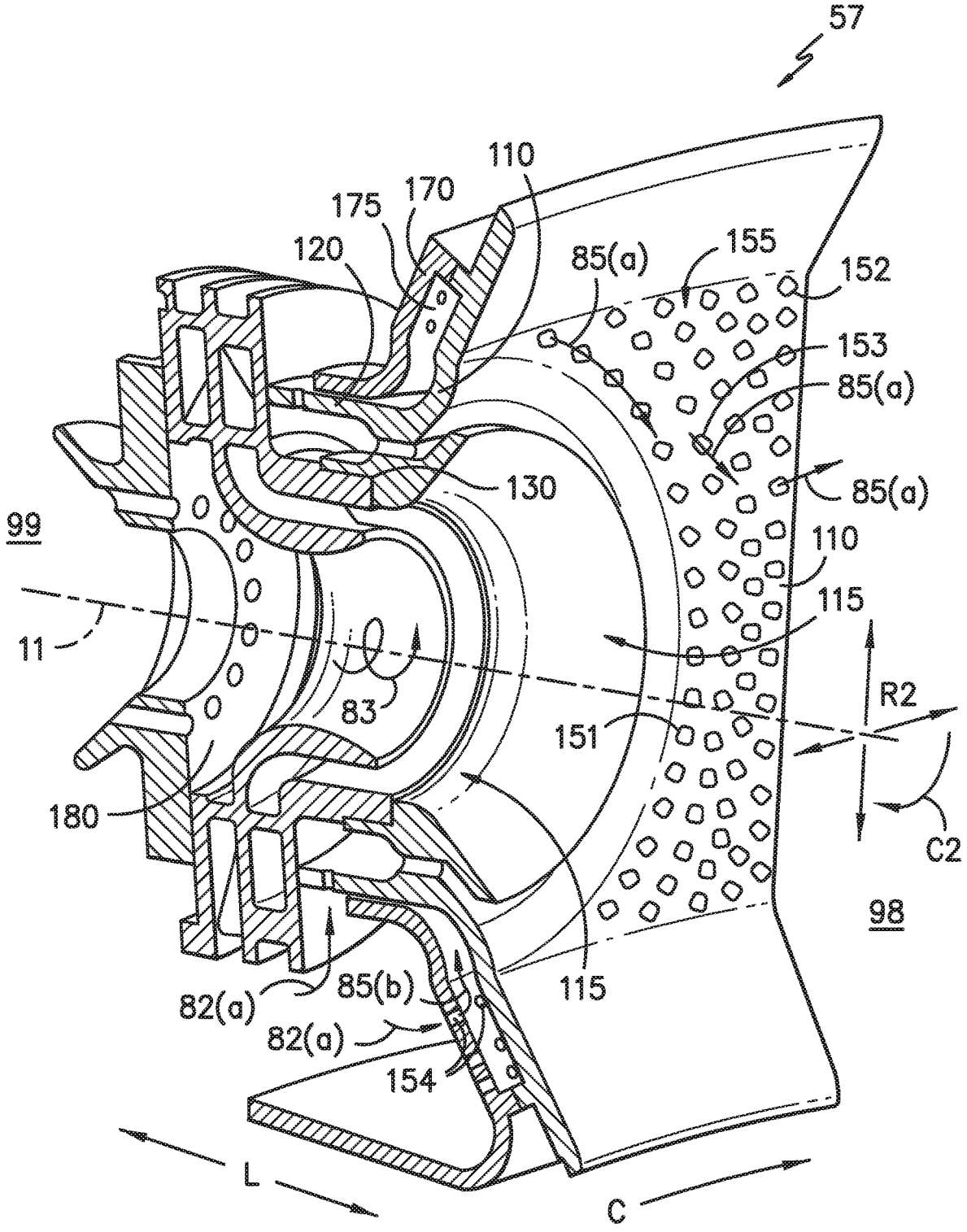
FIGS. 4-5 are perspective cutaway views of the portion of the combustor assembly generally provided in FIG. 3.
Figure 5:
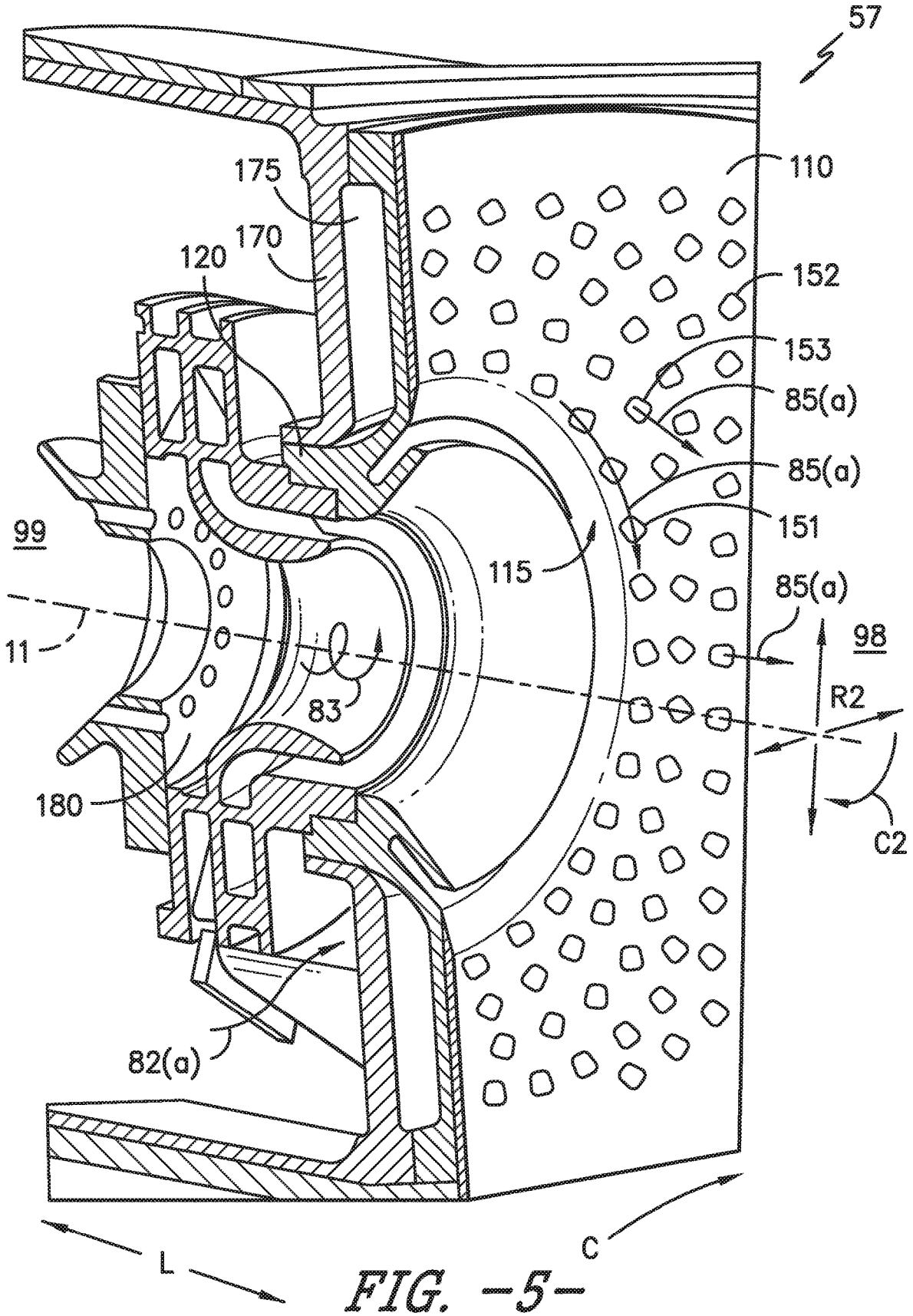

Referring now to FIGS. 3-5, exemplary embodiments of a portion of the combustor assembly 50 are generally provided. More specifically, a portion of the dome assembly 57 of the combustor assembly 50 is generally provided (fuel nozzle 70 removed for clarity). The dome assembly 57 includes a deflector wall 110 extended at least partially along a radial direction R and a circumferential direction C relative to the axial centerline 12 and adjacent to the combustion chamber 62. A deflector eyelet or fuel nozzle opening 115 is defined through the deflector wall 110, through which the fuel nozzle 70 (FIG. 2) at least partially extends. A nozzle centerline 11 is extended through the deflector eyelet or fuel nozzle opening 115 along a lengthwise direction L (see FIGS. 2-5).

Although the nozzle centerline 11 is generally provided, it should be appreciated that the fuel nozzle 70 may be disposed approximately concentric, or approximately eccentric, relative to the nozzle centerline 11 or the fuel nozzle opening 115. Therefore, the nozzle centerline 11 may be an approximation of a centerline through the fuel nozzle opening 115, with the fuel nozzle 70 concentric or eccentric through the fuel nozzle opening 115. A radial direction R2 is generally provided in FIG. 3 as reference extended from the nozzle centerline 11.

In various embodiments, the deflector wall 110 is defined generally around the nozzle centerline 11, such as along a radial direction R2 extended from the nozzle centerline 11. Still further, the fuel nozzle opening 115 is defined generally through the deflector wall 110 around the nozzle centerline 11, such as defined via one or more radii extended from the radial direction R2.

The dome assembly 57 further includes an annular axial wall 120 coupled to the deflector wall 110 and extended through the fuel nozzle opening 115. The axial wall 120 is defined around the nozzle centerline 11. For example, the axial wall 120 may be defined annularly around the nozzle centerline 11.

The dome assembly 57 further includes an annular shroud 130 defined around the nozzle centerline 11 and extended co-directional to the axial wall 120. In one embodiment, the axial wall 120 and the annular shroud 130 are each coupled to a radial wall 140 defined upstream of the deflector wall 110. In other embodiments, however, the axial wall 120 is at least partially separate from the radial wall 140.

Figure 6:
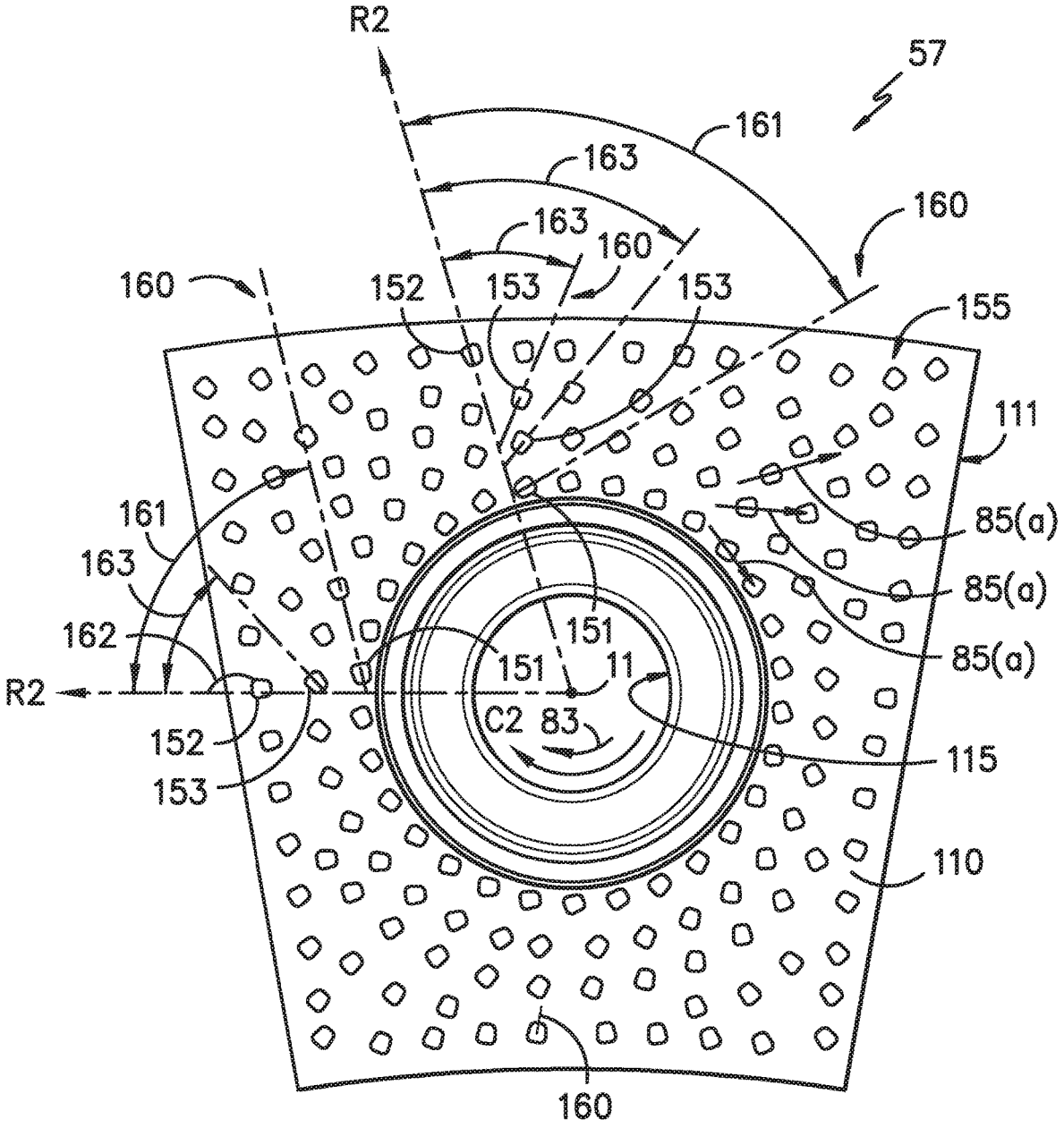
FIG. 6 is a flowpath view of a deflector wall of the combustor assembly generally provided in FIG. 5.

Referring now to FIG. 6, a downstream looking upstream view of the deflector wall 110 is generally provided. The deflector wall 110 defines a plurality of openings 155 through the deflector wall 110. The plurality of openings 155 are defined around the fuel nozzle opening 115, such as along radii extended along the radial direction R2 relative to the nozzle centerline 11. The plurality of openings 155 each define an angle at which a flow of oxidizer 85(*a*) egresses through the plurality of openings 155 into the combustion chamber 62. For example, the plurality of openings 155 may generally define a shaped opening such as to dispose the flow of oxidizer 85(*a*) from the plurality of openings 155 along a generally tangential direction into the combustion chamber 62. The angle may be based on the radial direction R2 extended from the nozzle centerline 11 and a reference line 160 of the plurality of openings 155. The reference line 160 depicts an orientation of each shaped opening of the plurality of openings 155 generally at which the flow of oxidizer 85(*a*) is disposed into the combustion chamber 62.

The plurality of openings 155 defines at least a first set of openings 151 at one or more of a first radius relative to the nozzle centerline 11. The first set of openings 151 defines one or more of a first angle 161 relative to the radial direction R2. In various embodiments, the first angle 161 is defined between approximately 60 degrees and approximately 100 degrees relative to the radial direction R2. For example, the first angle 161 at 90 degrees defines the first set of openings 151 as providing the flow of oxidizer 85(*a*) essentially tangential relative to the fuel nozzle opening 115.

The first radius of the first set of openings 151 is defined proximate to the fuel nozzle opening 115 along the radial direction R2. For example, the first radius may be one or more radii from the nozzle centerline 11 more proximate to the fuel nozzle opening 115 in contrast to a second radius and a third radius further discussed below.

The plurality of openings 155 further defines a second set of openings 152 at or greater than a second radius. The second radius is greater than the first radius relative to the fuel nozzle opening 115. The second set of openings 152 defines one or more of a second angle 162 relative to the radial direction R2 between approximately zero and approximately 30 degrees. For example, the second angle 162 at zero degrees defines the second set of openings 152 as providing the flow of oxidizer 85(*a*) essentially along the radial direction R2 relative to the nozzle centerline 11. In various embodiments, the second set of openings 152 is disposed at least approximately along the radial direction R2 relative to the nozzle centerline 11. As such, the second set of openings 152 of the plurality of openings 155 may provide the flow of oxidizer 85(*a*) into the combustion chamber 62 at least approximately along the radial direction R2 away from the nozzle centerline 11.

The second radius of the second set of openings 152 is defined generally least proximate to the fuel nozzle opening 115 along the radial direction R2, such as in contrast to the one or more radii of the first radius or the third radius. For example, the second set of openings 152 may be defined proximate to an outer perimeter or edges 111 of each segment of deflector wall 110.

The plurality of openings 155 further defines a third set of openings 153 at one or more of a third radius between the first radius and the second radius along the radial direction R2. The third set of openings 153 defines one or more of a third angle 163 relative to the radial direction R2 between the first angle 161 and the second angle 162. For example, the third angle 163 is defined generally between tangential to the fuel nozzle opening 115 and along the radial direction R2. In various embodiments, the third angle 163 of the third set of openings 153 is between approximately 20 degrees and approximately 75 degrees.

Referring still to the exemplary embodiment generally provided in FIG. 6, the first set of openings 151 and the third set of openings 153 are together disposed at least partially co-directional along a circumferential direction C2 relative to the nozzle centerline 11. For example, the first set of openings 151 and the third set of openings 153 may together be disposed generally along a clockwise direction relative to the fuel nozzle opening 115. As another example, the first set of openings 151 and the third set of openings 153 may together be disposed generally along a counter-clockwise direction relative to the fuel nozzle opening 115. As such, in various embodiments, the plurality of openings 155 may generally egress the flow of oxidizer 85(*a*) along a clockwise direction or a counter-clockwise direction relative to the nozzle centerline 11.

Referring back to FIGS. 3-5, the combustor assembly 50 further includes a swirler assembly 180 disposed generally around the nozzle centerline 11. The swirler assembly 180 is disposed generally concentric to the fuel nozzle opening 115. However, it should be appreciated that the swirler assembly 180 is generally moveable relative to the nozzle centerline 11 such as to be defined at least partially eccentric to the nozzle centerline 11 or fuel nozzle opening 115. The swirler assembly 180 provides a flow of fluid, shown schematically as arrow 83, into the combustion chamber 62 at least partially along the circumferential direction C2 relative to the nozzle centerline 11. In various embodiments, the flow of fluid 83 is at least a portion of the flow of oxidizer 82 from the compressors 22, 24 (FIGS. 1-2). In still various embodiments, the flow of fluid 83 is further a mixture of fuel and the flow of oxidizer 82.

In one embodiment, the flow of fluid 83 is at least partially along the circumferential direction C2 relative to the nozzle centerline 11 and is defined generally co-directional to the flow of oxidizer 85(*a*) egressed through the plurality of openings 155 through the deflector wall 110. For example, as generally provided in FIG. 6, the flow of fluid 83 may generally flow through the fuel nozzle opening 115 along a first circumferential direction along the circumferential direction C2 (viewed downstream looking upstream). The plurality of openings 155 may further be oriented generally along the first circumferential direction, such as to define an at least partially co-swirling flow of oxidizer 85(*a*) and the flow of fluid 83 through the plurality of openings 155 and through the fuel nozzle opening 115. More specifically, the reference line 160 and angles of the plurality of openings 155 may be at least partially disposed co-directional along the circumferential direction C2 as the direction of the flow of fluid 83 into the combustion chamber 62. Still further, the first set of openings 151 and the third set of openings 153 may more specifically be disposed at least partially co-directional along the circumferential direction C2 as the direction of the flow of fluid 83 into the combustion chamber 62. It should be appreciated that in various embodiments the first circumferential direction relative to circumferential direction C2 may be clockwise or counter-clockwise.

However, in still other embodiments, the flow of fluid 83 may be defined through the swirler assembly 180 into the combustion chamber 62 as generally counter-directional along the circumferential direction C2 relative to the flow of oxidizer 85(*a*) egressed through the plurality of openings 155 through the deflector wall 110. For example, the plurality of openings 155 may be defined along a first circumferential direction relative to the circumferential direction C2. The flow of fluid 83 from the swirler assembly 180 into the combustion chamber 62 may be disposed at least partially along the circumferential direction C2 along a second circumferential direction opposite of the first circumferential direction.

Referring now to FIGS. 3-6, in various embodiments, the combustor assembly 50 defines a pressure loss or pressure drop from an upstream side (e.g., proximate to upstream end 99) of the dome assembly 57 adjacent to the diffuser cavity 84 to a downstream side (e.g., proximate to downstream end 98) of the deflector wall 110 adjacent to the combustion chamber 62. In one embodiment, the pressure drop is between approximately 3% and approximately 5%. For example, the combustor assembly 50 may define a support wall 170 upstream of the deflector wall 110. The support wall 170 is extended at least partially along the radial direction R, such as generally co-directional to the deflector wall 110 along a general cold side, such as adjacent to the diffuser cavity 84. The support wall 170 and the deflector wall 110 may together define a cavity 175 therebetween. In various embodiments, the cavity 175 defines a substantially sealed cavity between the support wall 170 and the deflector wall 110 such as to dispose a flow of oxidizer 85(*a*) through the plurality of openings 151, 152, 153. A plurality of support wall openings 154 may be defined through the support wall 170 to admit a flow of oxidizer 85(*b*) into the cavity 175. The flow of oxidizer 85(*b*) is generally a portion of the flow of oxidizer 82(*a*). The flow of oxidizer 85(*b*) then egresses from the cavity 175 into the combustion chamber 62 via the plurality of openings 155 (FIGS. 4-6). In various embodiments, the pressure of the flow of oxidizer 85(*a*)

downstream of the deflector wall 110 may be approximately 3% to approximately 5% less than the pressure of the flow of oxidizer 82(*a*) upstream of the support wall 170.

In still various embodiments, the pressure drop of the flow of oxidizer 85(*b*) in the cavity 175 between the deflector wall 110 and the support wall 170 is approximately 50% to 90% of the overall pressure drop from upstream of the support wall 170 (e.g., flow of oxidizer 82(*a*)) to downstream of the deflector wall 110 (e.g., flow of oxidizer 85(*a*)). In still yet various embodiments, the pressure drop of the flow of oxidizer 85(*a*) downstream of the deflector wall 110 (i.e., at the combustion chamber 62) from the cavity 175 to the combustion chamber 62 is approximately 10% to approximately 50% of the overall pressure drop from upstream of the support wall 170 (e.g., diffuser cavity 84) to downstream of the deflector wall 110 (e.g., combustion chamber 62).

In still various embodiments, the combustor assembly 50 may egress between approximately 3% and approximately 10% of a total flow of oxidizer (e.g., $Wa_{36}$) into the combustion chamber 62 through the plurality of openings 155 through all deflector walls 110 arranged in the combustor assembly 50. For example, referring to FIG. 2, the total flow of oxidizer may generally be depicted as flow of oxidizer 82(*a*).

Figure 7:
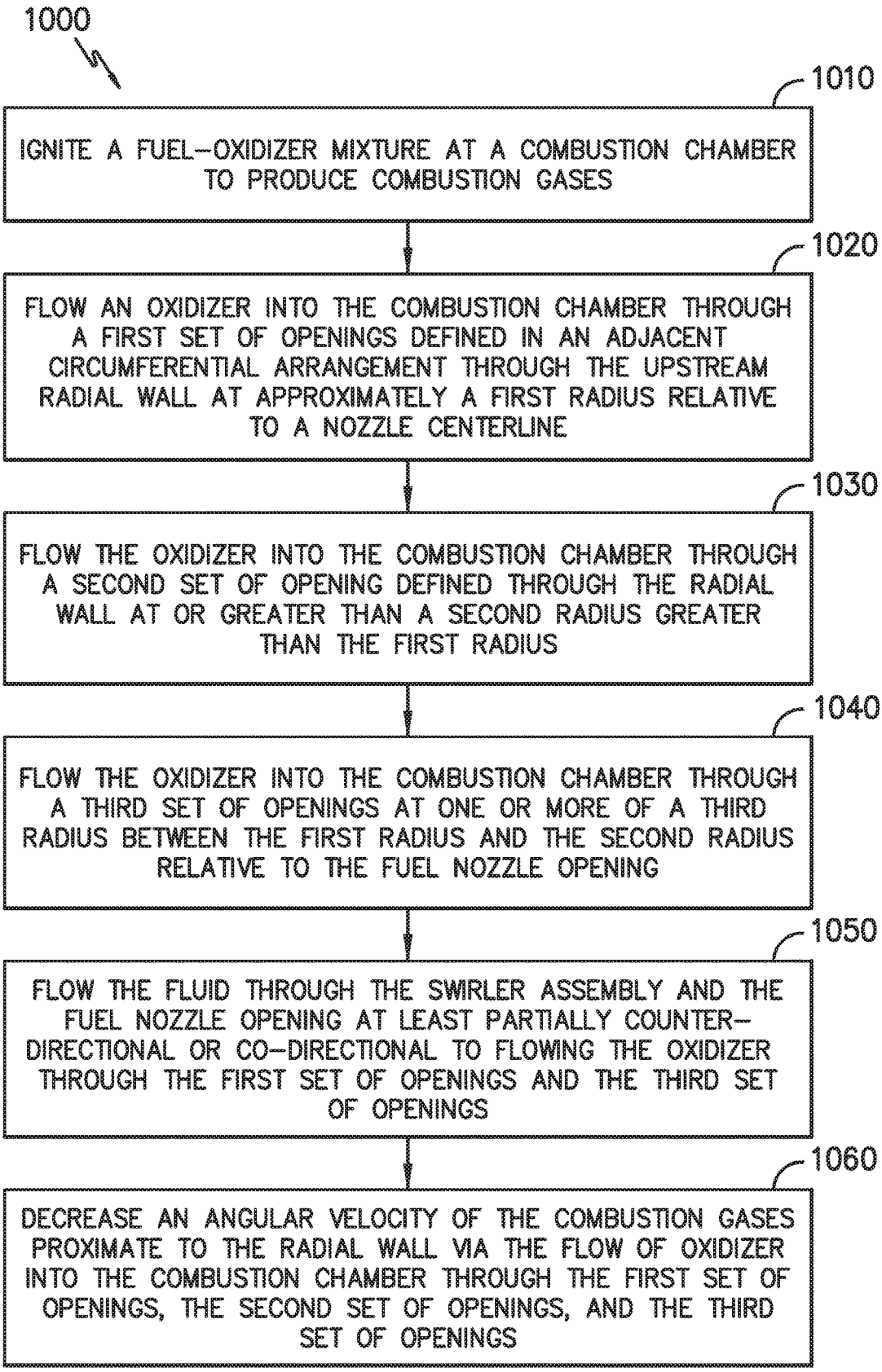
FIG. 7 is a flowchart outlining exemplary steps of methods for operating the combustor assembly and gas turbine engine.

Referring now to FIG. 7, a flowchart outlining exemplary steps of methods for operating a gas turbine engine to decrease emissions and for operating a gas turbine engine to improve combustor durability are generally provided (hereinafter, "method 1000"). The method 1000 may be utilized and implemented with one or more embodiments of a combustor assembly and gas turbine engine such as generally provided in FIGS. 1-6. However, it should further be appreciated that the method 1000 may be utilized and implemented with embodiments not generally shown or provided herein. It should still further be appreciated that though the method 1000 outlines steps in a certain arrangement, the steps may be re-ordered, re-arranged, re-sequenced, as well as added or omitted without removing from the scope of the present disclosure.

The method 1000 includes at 1010 igniting a fuel-oxidizer mixture at a combustion chamber to produce combustion gases; at 1020 flowing an oxidizer into the combustion chamber through a first set of openings defined in an adjacent circumferential arrangement through the upstream radial wall at approximately a first radius relative to a nozzle centerline; at 1030 flowing the oxidizer into the combustion chamber through a second set of openings defined through the radial wall at or greater than a second radius greater than the first radius; and at 1040 flowing the oxidizer into the combustion chamber through a third set of openings at one or more of a third radius between the first radius and the second radius relative to the fuel nozzle opening.

In various embodiments at 1010, the combustion chamber is formed at least in part by an upstream radial wall through which a fuel nozzle is disposed, such as the dome assembly 57 and deflector wall 110 generally shown and described in regard to FIGS. 1-6.

In one embodiment at 1010, the first set of openings egresses the oxidizer into the combustion chamber at a first angle between approximately 60 degrees and approximately 100 degrees relative to a radial direction defined from the nozzle centerline, such as generally shown and described in regard to FIGS. 3-6. In another embodiment at 1020, the second set of openings egresses the oxidizer into the combustion chamber at a second angle between approximately 0 degrees and approximately 30 degrees relative to the radial direction defined from the nozzle centerline, such as generally shown and described in regard to FIGS. 3-6. In one embodiment, flowing the oxidizer into the combustion chamber includes flowing the oxidizer through the second set of openings generally radially outward relative to the nozzle centerline. In still yet another embodiment, the third set of openings egresses the oxidizer into the combustion chamber at one or more of a third angle relative to the radial direction between the first angle and the second angle, such as generally shown and described in regard to FIGS. 3-6.

In various embodiments, flowing the oxidizer into the combustion chamber includes flowing the oxidizer through the first set of openings and the third set of openings at least partially co-directional along a circumferential direction relative to the nozzle centerline. Such as generally shown and described in regard to FIGS. 3-6, flowing the oxidizer into the combustion chamber may be generally along a clockwise direction or a counter-clockwise direction relative to a nozzle centerline.

In various embodiments, the method 1000 may further include at 1050 flowing a fluid into the combustion chamber through a swirler assembly and a fuel nozzle opening, such as generally shown and described in regard to FIGS. 3-6. In one embodiment at 1050, flowing the fluid through the swirler assembly and the fuel nozzle opening is at least partially co-directional to flowing the oxidizer through the first set of openings and the third set of openings. As previously described, flowing the fluid and flowing the oxidizer may be along a clockwise direction or a counter-clockwise direction relative to the nozzle centerline. In another embodiment at 1050, flowing the fluid through the swirler assembly and the fuel nozzle opening is at least partially counter-directional to flowing the oxidizer through the first set of openings and the third set of openings. For example, the flow of fluid may be at least partially along a first circumferential direction and the flow of oxidizer may be at least partially along a second circumferential direction opposite of the first circumferential direction.

In another embodiment, the method 1000 further includes at 1060 decreasing an angular velocity of the combustion gases proximate to the radial wall via the flow of oxidizer into the combustion chamber through the first set of openings, the second set of openings, and the third set of openings.

Embodiments of the combustor assembly 50 and methods of operation 1000 that improve structural durability of combustor walls while further improving emissions output are generally shown and described in regard to FIGS. 1-7. The combustor assembly 50 generally includes a plurality of segments of an upstream wall or deflector wall 110 in adjacent arrangement along the circumferential direction C relative to the axial centerline 12 of the engine 10. The deflector wall 110 is adjacent to and partially defines the combustion chamber 62. The support wall 170 may be defined upstream of the deflector wall 110 and adjacent to a pressure plenum or diffuser cavity 84. The support wall 170 defines a support wall opening 154 therethrough to the cavity 175 between the support wall 170 and the deflector wall 110. The flow of oxidizer 85(*b*) through the support wall opening 154 into the cavity 175 provides impingement cooling flow of oxidizer to an upstream side of the deflector wall 110 (e.g., within the cavity 175). The deflector wall 110 defines a plurality of openings 155 therethrough to provide the flow of oxidizer 85(*a*) to the combustion chamber 62. The plurality of openings 155 includes the first set of openings 151 arranged to provide the flow of oxidizer 85(*a*) at least approximately tangential relative to the deflector eyelet or fuel nozzle opening 115 through the deflector wall 110 through which the fuel nozzle 70 is at least partially disposed. The plurality of openings 155 further includes the another set of openings, such as the third set of openings 153 arranged radially outward of the first set of openings 151 relative to the nozzle centerline 11. The third set of openings 153 provides the flow of oxidizer 85(*a*) through the deflector wall 110 into the combustion chamber 62 at one or more angles 163 between approximately tangential relative to the fuel nozzle opening 115 and approximately radial relative to the nozzle centerline 11. The plurality of openings 155 further includes yet another set of openings, such as the second set of openings 152, arranged radially outward of the third set of openings 153, such as up to or including an edge or perimeter 111 of each segment of deflector wall 110. The second set of openings 152 provides the flow of oxidizer 85(*a*) through the deflector wall 110 into the combustion chamber 62 at an angle approximately radial relative to the nozzle centerline 11, such as generally along the radial direction R2.

As such, the deflector wall 110 defines the plurality of openings 155 as a generally smooth transition from at least approximately tangent relative to the fuel nozzle opening 115 (e.g., the first set of openings 151) to approximately radial relative to the nozzle centerline 11 (e.g., the second set of openings 152). The transition of the plurality of openings 155 may generally minimize an interaction of the flow of oxidizer 85(*a*) through the deflector wall 110 into the combustion chamber 62 with a primary combustion zone 62(*a*) flame structure within the combustion chamber 62 (e.g., adjacent to or otherwise proximate to the deflector wall 110). Minimizing the interaction or disruption of the primary combustion zone 62(*a*) flame structure may further improve emissions output, such as by decreasing formation of oxides of nitrogen (NOx) in the combustion chamber 62.

Furthermore, the plurality of openings 155 such as defined herein may further reduce an angular momentum supplied by the flow of oxidizer 85(*a*) through the deflector wall 110. The reduced angular momentum may further improve cooling at the deflector wall 110, and thereby improve structural durability of the combustor assembly 50, while the overall reduction in angular momentum due to the transition to the nearly radial second set of openings 152 mitigates or eliminates interaction or disruption of a primary zone 62(*a*) flame structure in the combustion chamber 62, thereby reducing emissions such as NOx.

The transition of the plurality of openings 155 from providing an approximately tangential flow relative to the fuel nozzle opening 115 to an approximately radial flow proximate to outer radii or edges 111 of the deflector wall 110 may generally provide deflector wall 110 cooling while mitigating adverse effects associated with a substantially tangential arrangement or substantially radial arrangement of the plurality of openings. For example, as previously described, the transition of plurality of openings 155 may generally decrease an angular momentum of the flow of oxidizer 85(*a*) into the combustion chamber 62 versus a substantially tangential arrangement of plurality of openings, thereby decreasing formation of NOx due to adverse interaction or disruption to the primary zone 62(*a*) flame structure.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A combustor assembly for a gas turbine engine, the combustor assembly comprising:

a deflector wall defined around a nozzle centerline extended therethrough, and extending in a circumferential direction with respect to a combustor centerline axis, the deflector wall comprising a radially outward portion with respect to the combustor centerline axis and a radially inward portion with respect to the combustor centerline axis, wherein at least one of the radially outward portion of the deflector wall and the radially inward portion of the deflector wall forms a non-perpendicular angle with respect to the combustor centerline axis;

a support wall that is defined around the nozzle centerline extended therethrough and that is disposed on an upstream side of the deflector wall, the support wall having a plurality of apertures therethrough; and a cavity formed by the deflector wall and the support wall, the cavity receiving a flow of oxidizer from the apertures through the support wall and providing the flow of oxidizer to a plurality of openings through the deflector wall, the cavity providing a drop in pressure of the flow of oxidizer passing therethrough;

an annular axial wall extending upstream from the upstream end of the deflector wall and forming an annular chamber radially inward of the annular axial wall, the annular chamber having inlet holes in the annular axial wall and outlet holes, the annular axial wall separating an internal space of the annular chamber from an internal space of the cavity;

wherein a plurality of radial directions are defined from the nozzle centerline, wherein the deflector wall is extended at least partially along the plurality of radial directions, the deflector wall defining an upstream wall of a combustion chamber, wherein the deflector wall defines a fuel nozzle opening through the deflector wall and around the nozzle centerline, wherein the plurality of openings are defined through the deflector wall and around the fuel nozzle opening, wherein the plurality of openings each define an angle at which the flow of oxidizer egresses therethrough into the combustion chamber, wherein the plurality of openings defines a first set of openings, a second set of openings, and a third set of openings, wherein each of the first set of openings is at a first radial distance relative to the nozzle centerline, wherein the combustor assembly defines a second radial distance greater than the first radial distance relative to the fuel nozzle centerline, wherein each of the second set of openings is at or greater than the second radial distance relative to the fuel nozzle centerline, wherein each of the third set of openings is between the first radial distance and the second radial distance from the nozzle centerline, wherein each of the first set of openings defines the angle at which the flow of oxidizer egresses therethrough into the combustion chamber relative to one of the plurality of radial directions that is closest thereto in a counterclockwise direction that passes through one of the second set of openings in a first angle range between 60 degrees and 100 degrees, wherein each of the second set of openings defines the angle at which the flow of oxidizer egresses therethrough into the combustion chamber relative to one of the plurality of radial directions passing therethrough in a second angle range between zero and 30 degrees, and wherein each of the third set of openings defines the angle at which the flow of oxidizer egresses therethrough into the combustion chamber relative to one of the plurality of radial directions that is closest thereto in the counterclockwise direction that passes through one of the second set of openings in a third angle range between zero and 100 degrees.

2. The combustor assembly of claim 1, wherein the third angle range is between 20 degrees and 75 degrees.

3. The combustor assembly of claim 1, wherein the first set of openings and the third set of openings are together disposed at least partially co-directional along a circumferential direction relative to the nozzle centerline.

4. The combustor assembly of claim 1, wherein the second set of openings is disposed at least along one of the plurality of radial directions relative to the nozzle centerline.

5. The combustor assembly of claim 1, further comprising: a swirler assembly disposed generally around the nozzle centerline and generally concentric to the fuel nozzle opening, wherein the swirler assembly is configured to provide a flow of fluid into the combustion chamber at least partially along a circumferential direction relative to the nozzle centerline.

6. The combustor assembly of claim 5, wherein the flow of oxidizer from the first set of openings and the third set of openings into the combustion chamber and the flow of fluid from the swirler assembly into the combustion chamber are both along a clockwise direction relative to the nozzle centerline, or are both along a counter-clockwise direction relative to the nozzle centerline.

7. The combustor assembly of claim 1, wherein an upstream side of the combustor assembly to a downstream side of the deflector wall at the combustion chamber comprises a pressure drop between 3% and 5%.

8. The combustor assembly of claim 1, wherein the first set of openings, the second set of openings, and the third set of openings are arranged to egress the flow of oxidizer along a clockwise direction or the counter-clockwise direction relative to the nozzle centerline.

9. The combustor assembly of claim 1, wherein an outlet of each of the first set of openings, the second set of openings, and the third set of openings is shaped such that a downstream end thereof is wider than an upstream end thereof.

10. The combustor assembly of claim 1, wherein the plurality of openings are defined through a middle portion of the deflector wall and not through the radially outward portion or the radially inward portion.

11. A method for operating a gas turbine engine to decrease emissions, the method comprising:

flowing an oxidizer through apertures in a support wall into a cavity formed by the support wall and a deflector wall;

the deflector wall defined around a nozzle centerline extended therethrough, and extending in a circumferential direction with respect to a combustor centerline axis, the deflector wall comprising a radially outward portion with respect to the combustor centerline axis and a radially inward portion with respect to the combustor centerline axis, wherein at least one of the radially outward portion of the deflector wall and the radially inward portion of the deflector wall forms a non-perpendicular angle with respect to the combustor centerline axis;

flowing the oxidizer through an annular chamber defined radially inward of an annular axial wall extending upstream from the upstream end of the deflector wall, the annular chamber having inlet holes in the annular axial wall and outlet holes, the annular axial wall separating an internal space of the annular chamber from an internal space of the cavity;

dropping a pressure of the oxidizer while passing through the cavity;

flowing the oxidizer from the cavity into a combustion chamber through a first set of openings defined through the deflector wall;

flowing the oxidizer from the cavity into the combustion chamber through a second set of openings defined through the deflector wall;

flowing the oxidizer from the cavity into the combustion chamber through a third set of openings defined through the deflector wall;

wherein the deflector wall defines a plurality of radial directions defined from the nozzle centerline, wherein each of the first set of openings is defined in an adjacent circumferential arrangement through the deflector wall at a first radial distance relative to the nozzle centerline, wherein each of the first set of openings egresses the oxidizer into the combustion chamber relative to one of the plurality of radial directions that is closest thereto in a counterclockwise direction that passes through one of the second set of openings at an angle in a first angle range between 60 degrees and 100 degrees, wherein the deflector wall defines a second radial distance greater than the first radial distance relative to the fuel nozzle centerline, wherein each of the second set of openings is defined through the deflector wall at or greater than the second radial distance from the nozzle centerline, wherein each of the second set of openings egresses the oxidizer into the combustion chamber relative to one of the plurality of radial directions that passes therethrough at an angle in a second angle range between 0 degrees and 30 degrees, wherein each of the third set of openings is defined through the deflector wall between the first radial distance and the second radial distance relative to the fuel nozzle centerline, and wherein each of the third set of openings egresses the oxidizer into the combustion chamber relative to one of the plurality of radial directions that is closest thereto in the counterclockwise direction and that passes through one of the second set of openings at an angle in a third angle range between zero and 100 degrees.

12. The method of claim 11, wherein flowing the oxidizer into the combustion chamber includes flowing the oxidizer through the first set of openings and the third set of openings at least partially co-directional along a circumferential direction relative to the nozzle centerline.

13. The method of claim 11, wherein flowing the oxidizer into the combustion chamber includes flowing the oxidizer through the second set of openings generally radially outward relative to the nozzle centerline.

14. The method of claim 11, further comprising: flowing a fluid into the combustion chamber through a swirler assembly and a fuel nozzle opening.

15. The method of claim 14, wherein flowing the fluid through the swirler assembly and the fuel nozzle opening is at least partially co-directional to flowing the oxidizer through the first set of openings and the third set of openings.

16. The method of claim 14, wherein flowing the fluid through the swirler assembly and the fuel nozzle opening is at least partially counter-directional to flowing the oxidizer through the first set of openings and the third set of openings.

17. The method of claim 11, further comprising: decreasing an angular velocity of combustion gases proximate to the deflector wall via the flow of oxidizer into the combustion chamber through the first set of openings, the second set of openings, and the third set of openings.

18. The method of claim 11, wherein the third angle range is between 20 degrees and 75 degrees.

19. The method of claim 11, the method comprising: flowing the oxidizer through the first set of openings, the second set of openings, and the third set of openings collectively between 3% and 10% of a total flow of oxidizer into the combustion chamber.

20. The method of claim 11, the method comprising: generating a pressure drop between of the flow of oxidizer from an upstream side of a dome assembly to a downstream side of the deflector wall at the combustion chamber, wherein the pressure drop is between 3% and 5%.

21. A method for operating a combustor of a gas turbine engine to increase combustor durability, the method comprising:

flowing an oxidizer through apertures in a support wall into a cavity formed by the support wall and a deflector wall;

the deflector wall defined around a nozzle centerline extended therethrough, and extending in a circumferential direction with respect to a combustor centerline axis, the deflector wall comprising a radially outward portion with respect to the combustor centerline axis and a radially inward portion with respect to the combustor centerline axis, wherein at least one of the radially outward portion of the deflector wall and the radially inward portion of the deflector wall forms a non-perpendicular angle with respect to the combustor centerline axis;

flowing the oxidizer through an annular chamber defined radially inward of an annular axial wall extending upstream from the upstream end of the deflector wall, the annular chamber having inlet holes in the annular axial wall and outlet holes, the annular axial wall separating an internal space of the annular chamber from an internal space of the cavity;

dropping a pressure of the oxidizer while passing through the cavity;

flowing the oxidizer from the cavity into a combustion chamber through a first set of openings defined through the deflector wall;

flowing the oxidizer from the cavity into the combustion chamber through a second set of openings in the deflector wall;

flowing the oxidizer from the cavity into the combustion chamber through a third set of openings in the deflector wall;

wherein the deflector wall defines a plurality of radial directions defined from the nozzle centerline, wherein each of the first set of openings is defined in an adjacent circumferential arrangement through the deflector wall at a first radial distance relative to the nozzle centerline, wherein each of the first set of openings egresses the oxidizer into the combustion chamber relative to one of the plurality of radial directions that is closest thereto in a counterclockwise direction that passes through one of the second set of openings at an angle in a first angle range between 60 degrees and 100 degrees, wherein the deflector wall defines a second radial distance greater than the first radial distance relative to the fuel nozzle centerline, wherein each of the second set of openings is defined through the deflector wall at or greater than the second radial distance, wherein each of the second set of openings egresses the oxidizer into the combustion chamber relative to one of the plurality of radial directions that passes therethrough at an angle in a second angle range between 0 degrees and 30 degrees, wherein each of the third set of openings is defined through the deflector wall between the first radial distance and the second radial distance relative to the fuel nozzle centerline, and wherein each of the third set of openings egresses the oxidizer into the combustion chamber relative to one of the plurality of radial directions that is closest thereto in the counterclockwise direction and that passes through one of the second set of openings at an angle in a third angle range between zero and 100 degrees.

22. The method of claim 21, further comprising: decreasing an angular velocity of combustion gases proximate to the deflector wall via the flow of oxidizer into the combustion chamber through the first set of openings, the second set of openings, and the third set of openings.

23. The method of claim 21, wherein flowing the oxidizer into the combustion chamber includes flowing the oxidizer through the first set of openings and the third set of openings at least partially co-directional along a circumferential direction relative to the nozzle centerline.

* * * * *